US008696247B2

(12) United States Patent
Mungall

(10) Patent No.: US 8,696,247 B2
(45) Date of Patent: Apr. 15, 2014

(54) SYSTEMS AND METHODS FOR CONTROLLING RISERS

(75) Inventor: John Christian Hartley Mungall, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 242 days.

(21) Appl. No.: 12/708,690

(22) Filed: Feb. 19, 2010

(65) Prior Publication Data

US 2010/0147529 A1 Jun. 17, 2010

Related U.S. Application Data

(63) Continuation-in-part of application No. 12/118,937, filed on May 12, 2008, now Pat. No. 7,748,464, which is a continuation of application No. 11/162,141, filed on Aug. 30, 2005, now Pat. No. 7,416,025.

(51) Int. Cl.
*E21B 17/01* (2006.01)

(52) U.S. Cl.
USPC ..... 405/224.4

(58) Field of Classification Search
USPC ..... 405/224.4, 158, 168.1, 168.4, 171, 172; 441/2, 29; 114/330, 331, 333
See application file for complete search history.

(56) References Cited

U.S. PATENT DOCUMENTS

| | | | | |
|---|---|---|---|---|
| 3,394,553 | A * | 7/1968 | Henri | 405/203 |
| 3,583,169 | A * | 6/1971 | Morgan | 405/171 |
| 3,756,034 | A * | 9/1973 | Lochridge et al. | 405/167 |
| 3,849,997 | A * | 11/1974 | Gower | 405/171 |
| 3,855,803 | A * | 12/1974 | Lacroix | 405/206 |
| 3,992,889 | A * | 11/1976 | Watkins et al. | 405/224.2 |
| 4,048,945 | A * | 9/1977 | Shrum | 114/294 |
| 4,099,560 | A * | 7/1978 | Fischer et al. | 166/350 |
| 4,301,840 | A * | 11/1981 | Jansen | 141/98 |
| 4,422,801 | A * | 12/1983 | Hale et al. | 405/171 |
| 4,448,266 | A | 5/1984 | Potts | |
| 4,730,677 | A * | 3/1988 | Pearce et al. | 166/345 |
| 5,758,990 | A * | 6/1998 | Davies et al. | 405/224.4 |
| 6,004,074 | A * | 12/1999 | Shanks, II | 405/195.1 |
| 6,062,769 | A | 5/2000 | Cunningham | |
| 6,193,441 | B1 * | 2/2001 | Fisher | 405/224.4 |
| 6,210,075 | B1 * | 4/2001 | Korloo | 405/206 |
| 6,296,421 | B2 * | 10/2001 | Fisher | 405/224.4 |
| 6,364,022 | B1 | 4/2002 | Kodaissi et al. | |
| 6,394,702 | B2 * | 5/2002 | Fisher | 405/224.4 |
| 6,402,430 | B1 * | 6/2002 | Guesnon | 405/224.2 |
| 6,461,079 | B1 * | 10/2002 | Beaujean | 405/171 |
| 6,536,528 | B1 | 3/2003 | Amin et al. | |
| 6,752,214 | B2 | 6/2004 | Amin et al. | |
| 7,191,836 | B2 | 3/2007 | Bhat et al. | |
| 7,416,025 | B2 | 8/2008 | Bhat et al. | |
| 2007/0048093 | A1 | 3/2007 | Bhat et al. | |
| 2007/0107906 | A1 | 5/2007 | Bhat et al. | |
| 2007/0135003 | A1 * | 6/2007 | Filips et al. | 441/29 |
| 2008/0210433 | A1 | 9/2008 | Bhat et al. | |

* cited by examiner

*Primary Examiner* — Tara M. Pinnock
(74) *Attorney, Agent, or Firm* — Gary M. Machetta

(57) ABSTRACT

Systems and methods for controlling movement of an elongated member providing communication between a vessel and a subsea unit are provided. The method can include connecting a positively buoyant member to an elongated member at a first location and connecting a negatively buoyant member to the elongated member at a second location, wherein at least a portion of the negatively buoyant member rests on a seabed when the elongated member is in an operational null position.

13 Claims, 10 Drawing Sheets

SYSTEMS AND METHODS FOR CONTROLLING RISERS

CROSS-REFERENCE TO RELATED APPLICATIONS

This application is a continuation-in-part (CIP) of co-pending U.S. patent application having Ser. No. 12/118,937, filed on May 12, 2008, which is a continuation of U.S. Pat. No. 7,416,025 having Ser. No. 11/162,141, filed on Aug. 30, 2005, which are both incorporated by reference herein.

FIELD OF THE INVENTION

Embodiments of the present invention generally relate to systems and methods for offshore hydrocarbon production. More particularly embodiments of the present invention relate to systems and methods for controlling lateral and/or vertical movements of a riser.

DESCRIPTION OF THE RELATED ART

Offshore production facilities often include a floating or fixed platform stationed at the surface of the water and subsea equipment, such as a well head, positioned on the sea floor. Communication between the platform and subsea equipment is often carried out through one or more risers.

The risers used to communicate from the surface to the subsea equipment must withstand numerous forces and other stresses. The risers can move due to vessel or platform movement, current, changes in internal fluid density within the riser, and pressures, for example. The movement of the riser can deform a riser to the extent that severe or irreparable damage is sustained by the riser. Current systems and methods used for reducing damage to risers can be time consuming, labor intensive, costly, and/or ineffective.

There is a need, therefore, for improved systems and methods for controlling risers.

BRIEF DESCRIPTION OF THE DRAWINGS

So that the recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with publicly available information and technology.

Systems and methods for controlling movement of an elongated member providing communication between a vessel and a subsea unit are provided. The method can include connecting a positively buoyant member to an elongated member at a first location and connecting a negatively buoyant member to the elongated member at a second location, wherein at least a portion of the negatively buoyant member rests on a seabed when the elongated member is in an operational null position.

Figure 1:
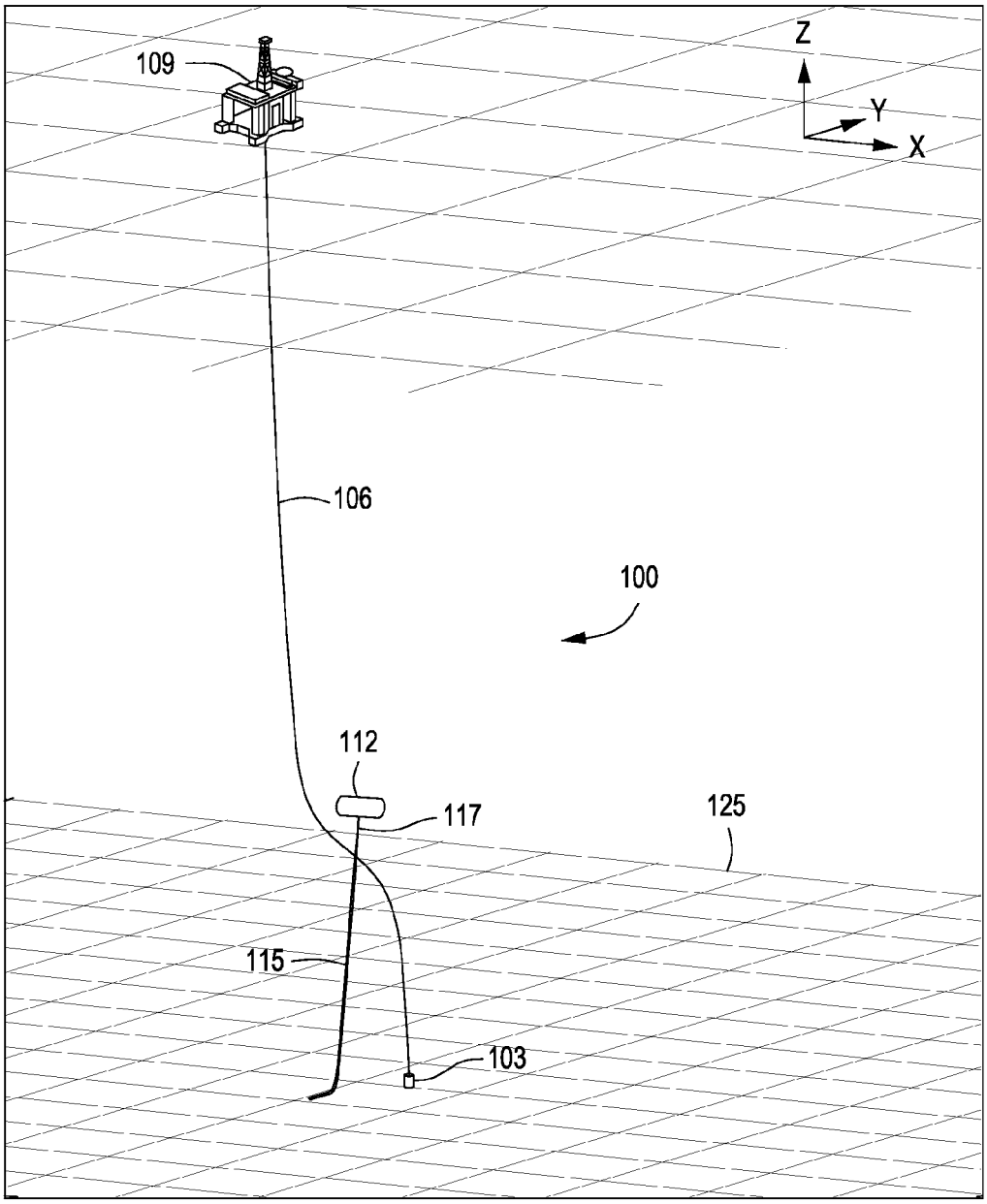
FIG. 1 depicts an isometric view of an illustrative offshore hydrocarbon production system, according to one or more embodiments described.
Figure 2:
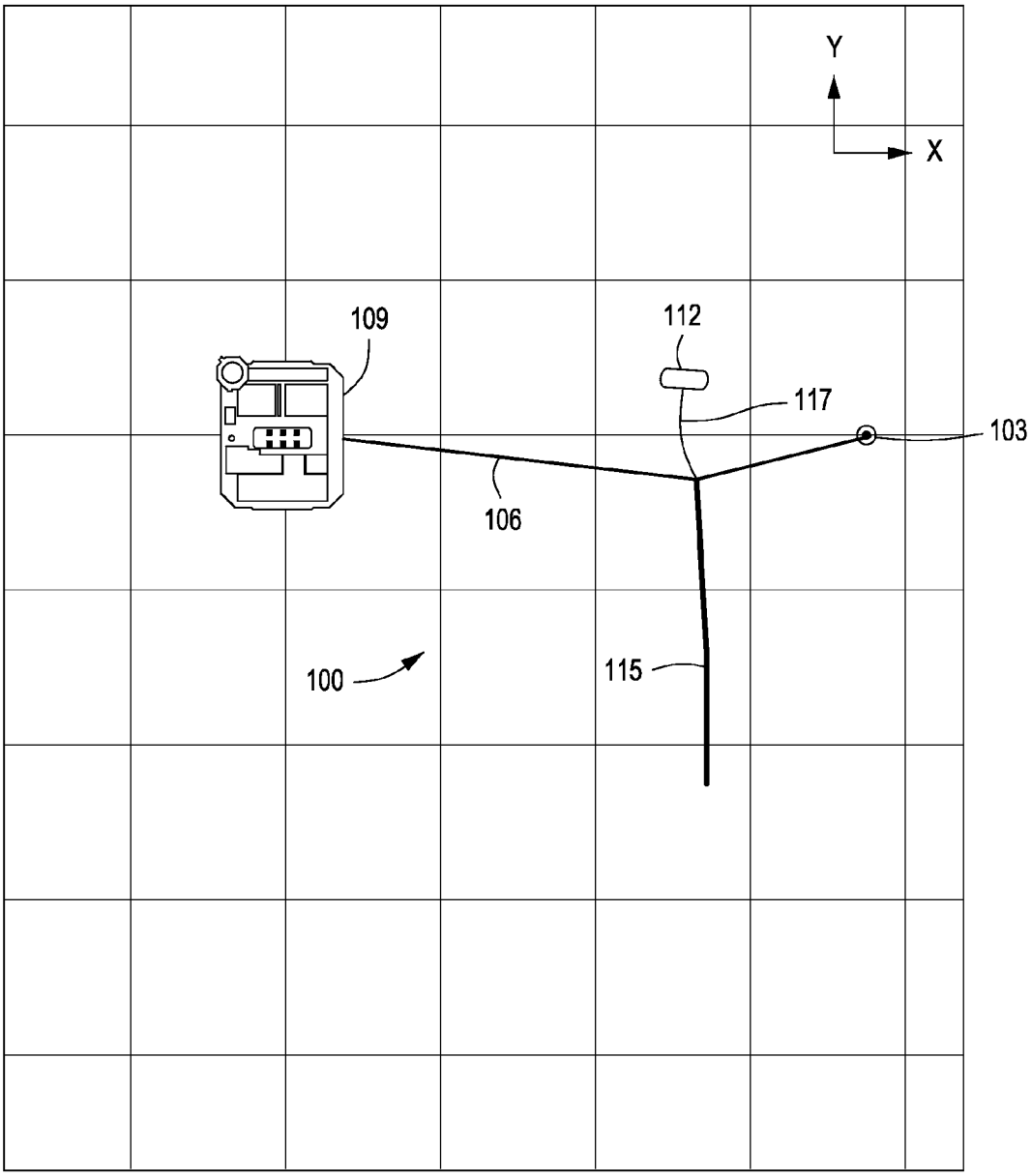
FIG. 2 depicts a plan view of the illustrative offshore hydrocarbon production system shown in FIG. 1.

FIG. 1 depicts an isometric view of an illustrative offshore hydrocarbon production system 100, according to one or more embodiments. FIG. 2 depicts a plan view of the illustrative offshore hydrocarbon production system 100 shown in FIG. 1. With reference to FIGS. 1 and 2, the hydrocarbon production system 100 can include, but is not limited to, one or more subsea units 103, one or more elongated members or "risers" 106, one or more vessels 109, one or more positively buoyant members 112 connected to the riser 106, and one or more negatively buoyant members 115 connected to the riser 106. As used herein, the terms "sea" and "subsea" include all bodies of water. As used herein, the term "riser" includes any elongated body or elongated member that can provide communication and/or support between a first location and a second location.

The riser 106 can be any type of elongated body or elongated member. The riser 106 can be suitable for any type of operation, for example hydrocarbon production operations, drilling operations, export/import operations, and/or communication operations. Illustrative risers 106 can include, but are not limited to, risers, cables, solid rods, ropes, or the like. In one or more embodiments, the riser 106 can be, but is not limited to, compliant vertical access risers ("CVAR"), flexible risers, steel catenary risers ("SCRs"), and variable tensioned risers. Other types of suitable risers 106 can include, but are not limited to, any conduit or solid members that can convey electrical power, communication signals, hydraulic lines, chemical lines, or any other type of communication and/or transfer operation. The riser 106 can be made from any suitable material or materials, which can include, but are not limited to, metals, metal alloys, rubbers, and polymers. In one or more embodiments, the riser 106 can be steel throughout.

The riser 106 can provide communication between the subsea unit 103 and the vessel 109. The positively buoyant member 112 can be connected to the riser 106 at a first location or first attachment point and the negatively buoyant member 115 can be connected to the riser 106 at a second location or second attachment point. In one or more embodiments, the distance between the first attachment point and the second attachment point can be about 75 m or less, about 50 m or less, about 40 m or less, about 30 m or less, about 20 m or less, about 15 m or less, about 10 m or less, about 5 m or less, about 3 m or less, or about 1 m or less. In one or more embodiments, the first attachment point and the second attachment point can be at the same or substantially the same location on the riser 106.

In one or more embodiments, at least a portion of the negatively buoyant member 115 can rest on the seabed 125. The portion of the negatively buoyant member 115 resting on the seabed 125 can fluctuate or change depending on the position of the riser 106. For example, as the second attachment point (i.e. the riser 106) moves toward the negatively buoyant member 115, the portion of the negatively buoyant member 115 resting on the seabed 125 can increase. Likewise, as the second attachment point moves away from the negatively buoyant member 115, the portion of the negatively buoyant member 115 resting on the seabed 125 can decrease. In one or more embodiments, at least a portion of the negatively buoyant member 115 can remain in contact, i.e. rest on the seabed 125, at all times. In one or more embodiments, the negatively buoyant member 115 can be lifted or raised off the seabed 125.

The movement of the riser in any direction, such as horizontal, vertical, or any combination thereof, can increase or decrease the portion of the negatively buoyant member 115 resting on the seabed 125. For example, as the second attachment point moves laterally away from the negatively buoyant member 115 the tension on the negatively buoyant member 115 can increase and at least a portion of the negatively buoyant member 115 resting on the seabed 125 can be lifted off and/or dragged along the seabed 125. Likewise, as the second attachment point moves laterally toward the negatively buoyant member 115 the tension on the negatively buoyant member 115 can decrease and the portion of the negatively buoyant member 115 resting on the seabed 125 can increase and/or be pushed along the seabed 125.

As illustrated, the negatively buoyant member 115 can rest on the seabed 125 at an angle relative to the riser 106. In one or more embodiments, the negatively buoyant member 115 can rest on the seabed 125 in a pile or puddle, thereby exerting a negative force on the riser 106 that is substantially vertical. As the riser 106 moves the negatively buoyant member 115 can be vertically displaced upward, downward, laterally, or a combination thereof.

The positively buoyant member 112 and the negatively buoyant member 115 can provide opposing forces that can stabilize the riser 106 and/or reduce the movement of the riser 106. The force exerted by the positively buoyant member 112 in the hydrocarbon production system 100 can cancel the force exerted by the negatively buoyant member 115, when the riser 106 is in an operational null position. As used herein, the term "operational null position" refers to a system arrangement having the vessel 109 in the center of a watch circle and no external forces, such as out of plane currents, are present. As used herein, the term "watch circle" refers to the diameter or distance of a circle within which vessel 109 is caused to move by various forces, for example wind, waves, and currents. The "watch circle" is such that the vessel 109 can efficiently utilize an offshore hydrocarbon production system 100 that includes two or more subsea units 103 connected via independent risers 106 to the vessel 109. The maximum offset from the center of the watch circle would be the radius or one half the diameter of the watch circle. When external and/or internal forces are exerted on the riser 106 the positively buoyant member 112 and the negatively buoyant member 115 provide or function as a "spring" that operates to return the riser to the preferred position, which is at or close to the operational null position.

Several external and/or internal factors, relative to the hydrocarbon production system 100, can influence the riser 106, which can result in unwanted movement or change in position of the riser 106. Illustrative factors that can influence the riser 106 can include, but are not limited to, movement of the vessel 109, water current, changes in the density of a fluid transported through the riser 106, the transport or movement of drill strings, pumps, and/or other tools through the riser 106 to the subsea unit 103, and wave action. For example, when the vessel 109 moves away from the base of the riser 106 the tension on the riser 106 can be increased and the riser 106 can straighten. Likewise, when the vessel 109 moves toward the base of the riser 106 the tension on the riser 106 can decrease, for example the riser 106 can be compressed, which can cause the curvature of the riser 106 to increase.

In one or more embodiments, the hydrocarbon production system 100 can accommodate wellhead offsets of about 5% or more, about 10% or more, about 25% or more, about 50% or more, about 60% or more, about 75% or more, about 90% or more, or about 100% or more of the depth of the water. Increasing the wellhead offset provides a hydrocarbon production system 100 capable of more effectively exploring a subsea geological formation. In other words, one vessel 109 can be connected to a plurality of risers 106 that span a large area of a geological formation, thereby eliminating the need for multiple vessels 109.

Referring to FIG. 2, the riser 106 is shown as being deflected out of plane or in other words, the riser 106 is placed into a three-dimensional position. Positioning the riser 106 into a three-dimensional orientation increases the length of the riser 106 that can be disposed between the subsea unit 103 and the vessel 109. The increased length of the riser 106 over a planar riser can provide a hydrocarbon production system 100 that can withstand more extreme forces.

The additional length of the riser 106 allowed for by the positively buoyant member 112 and the negatively buoyant member 115 (the three-dimensional position capability) can provide a hydrocarbon production system 100 capable of withstanding more intense storms, greater movement of the vessel 109, and other factors, than an offshore hydrocarbon production system that positions a riser in one plane. The increased length of riser 106 can allow the vessel 109 to move further away from the subsea unit 103 than in an offshore hydrocarbon production system that arranges a riser in one plane. The increased length of riser 106 can allow the vessel 109 to move closer toward the subsea unit 103 than an offshore hydrocarbon production system that arranges a riser in one plane. Therefore, the vessel 109 can require less control in positioning because the vessel 109 has a wider watch circle in which the vessel 109 can move about, whether the movement is vertical, horizontal, or a combination thereof.

Continuing with reference to FIGS. 1 and 2, the riser 106 can be used to conduct any number of hydrocarbon production operations. In one or more embodiments, these operations can include, but are not limited to, drilling operations, production operations, and work over operations. For example, one or more work over-tools or oil recovery enhancement devices, such as an electrical submersible pump ("ESP") can be transferred from the vessel 109 to the subsea unit 103 via the riser 106.

In one or more embodiments, the positively buoyant member 112 can be or include any buoyant material suitable for the environment in which the hydrocarbon production system 100 operates. For example, the buoyant material can be capable of withstanding the temperatures and pressures exerted by the surrounding water. In one or more embodiments, buoyant material of the positively buoyant member 112 can include, but is not limited to, syntactic foams, foamed thermosett or thermoplastic materials such as epoxy, urethane, phenolic, vinylester, polypropylene, polyethylene, polyvinylchlorides, nylons, thermoplastic or thermosett materials filled with particles (such as glass, plastic, microspheres, and/or ceramics), filled rubber or other elastic materials, composites of these materials, derivatives thereof, and/or combinations thereof.

In one or more embodiments, the positively buoyant member 112 can be or include a vessel or container having a hollow interior portion. The hollow interior portion can be at least partially filled with fluid, such as air and/or water, while still exhibiting positive buoyancy. In one or more embodiments, a portion of the fluid within the vessel or container can be removed or a fluid can be added to modify the buoyancy of the positively buoyant member 112. For example one or more valves and/or openings can be disposed through a wall of the vessel or container through which one or more fluids can be added to and/or removed from the hollow interior portion. A pump, a compressor, a remotely operated vehicle ("ROV"), or other device(s) can be used to introduce and/or remove a fluid from within the hollow interior of a buoyant vessel or container. The fluid can be introduced to and/or removed from one or more pipes that can be disposed about the riser 106, for example pipes at the top of the riser 106, the bottom of the riser 106, or anywhere therebetween. One or more controls can also be disposed about the riser 106, which can control the introduction of fluid to and/or from a positively buoyant member 112 having a hollow interior portion. In one or more embodiments, the vessel or container can be made from metal, rubber, such as latex, or synthetic polymers. For example, the vessel or container can be made from a latex material that can expand and contract as the pressure changes within the container due to the depth within the water the vessel is located and/or as fluid is removed and/or introduced to the container. In one or more embodiments, two or more positively buoyant members 112 can be in fluid communication with one another to permit fluid transfer therebetween.

In one or more embodiments, the positively buoyant member 112 can be connected or otherwise attached to the riser 106 by one or more lines 117. In one or more embodiments, the one or more lines 117 can be a metal wire or chain. In one or more embodiments, the line 117 can be a synthetic rope, such as a polyester rope. The line 117 can be any suitable or convenient length provided the positively buoyant member 112, when attached via line 117 to the riser 106 remains under the surface of the water or at least provides a sufficient buoyant force to the riser 106.

In one or more embodiments, the positively buoyant member 112 can have a density of less than about 550 kg/m$^3$, less than about 400 kg/m$^3$, less than about 300 kg/m$^3$, less than about 200 kg/m$^3$, less than about 100 kg/m$^3$, or less than about 50 kg/m$^3$. For example, the positively buoyant member 112 can have a density ranging from a low of about 5 kg/m$^3$, about 10 kg/m$^3$, or about 15 kg/m$^3$ to a high of about 50 kg/m$^3$, about 150 kg/m$^3$, or about 250 kg/m$^3$.

The negatively buoyant member 115 can be or include any non-buoyant material suitable for the environment in which the hydrocarbon production system 100 operates. The negatively buoyant member 115 can be or include metal, concrete, asphalt, ceramic, or combinations thereof. Suitable metals can include, but are not limited to steel, steel alloys, stainless steel, stainless steel alloys, non-ferrous metals, non-ferrous metal alloys, or combinations thereof. Suitable types of concrete can include, but are not limited to, regular, high-strength, high-performance, self-compacting, shotcrete, pervious, cellular, roller-compacted, air-entrained, ready-mixed, reinforced, or any other type. The material can be chosen based on the desired physical properties of the negatively buoyant member 115, such as corrosion resistance, density, hardness, ductility, malleability, tensile strength, environmental stresses such as temperature and pressure, as well as economic factors such as cost and availability.

In one or more embodiments, the negatively buoyant member 115 can be or include one or more flexible tension-bearing members. For example, the negatively buoyant member 115 can be or include one or more metal stud-link chains, metal stud-less chains, or a combination thereof. In one or more embodiments, the negatively buoyant member 115 can weigh about 50 kg/m or more, about 100 kg/m or more, about 150 kg/m or more, about 200 kg/m or more, or about 300 kg/m or more. In one or more embodiments, the negatively buoyant member 115 can have a density of more than about 1,050 kg/m$^3$, more than about 2,500 kg/m$^3$, more than about 4,000 kg/m$^3$, more than about 5,500 kg/m$^3$, more than about 6,500 kg/m$^3$, or more than about 7,500 kg/m$^3$.

In one or more embodiments, the negatively buoyant member 115 can be or include two or more weights connected together via one or more lines. The negatively buoyant member 115 can include a plurality of weights, for example concrete blocks strung together on a cable or line. The plurality of concrete blocks can be secured about the cable, such that the blocks do not move along the cable. In another example, the negatively buoyant member 115 can include a plurality of lines each having one or more weights disposed thereon. Two or more of the plurality of lines can be of different lengths to provide a variable restoring force on the riser 106 as the riser 106 moves laterally and/or vertically.

The vessel 109 can be any vessel suitable for connecting to the riser 106. The vessel 109 can include, but is not limited to, a ship, a semi-submersible, a drill ship, a tanker ship, a floating production unit or vessel ("FP"), a floating production offloading unit or vessel ("FPO"), a floating, production, storage and offloading unit or vessel ("FPSO"), a SPAR platform, a compliant tower ("CT"), fixed platforms, compliant platforms, moored buoys, dynamic positioning vessels, non-dynamic positioning vessels, vessels of all types, and tension leg platforms.

The vessel 109 can be equipped with drilling and/or production equipment suitable for carrying out drilling and/or production operations. The drilling operations can include well drilling, well completion, well work over, hydrocarbon fluid handling, and subsea manipulation of apparatus useful in drilling including trees, manifolds, wellheads, and jumpers ("drilling operations"). The production operations can include hydrocarbon production or other hydrocarbon fluid handling, and subsea manipulation of tools useful in hydrocarbon production ("production operations"). For example, production operations can include the offloading of produced hydrocarbons to a shuttle tanker.

The vessel 109 can include a hydrocarbon production storage facility disposed thereon and/or therein. In one or more embodiments, the hydrocarbon production storage facility can store produced hydrocarbon liquids, hydrocarbon gases, drilling liquids, sea water ballast, or any combination thereof. In one or more embodiments, the hydrocarbon production storage facility can be an integral part of the vessel 109. In one or more embodiments, the vessel 109 can include facilities for treating produced hydrocarbons. In one or more embodiments, the vessel 109 can include dry tree production system for connecting to and servicing multiple subsea units 103.

In one or more embodiments, the riser 106 can include curvature control devices intermediate the subsea unit 103 and the vessel 109 to increase the flexibility of the riser 106 and to decrease failure of the riser 106 due to wind, wave, vessel 109 movement, and current forces. As used herein, the term "curvature control device" refers to a device used for controlling curvature, stress, and/or bending or flex in the riser 106. The curvature control device can include traditional stress joints, taper joints, flexible joints, or other device or devices that can limit and/or control the curvature, stress, and/or bending or flex in the riser 106. This can be especially important in shallow to intermediate water depths where wind, wave, and current action are exaggerated. In one or more embodiments, one or more curvature control devices can be located around the attachment point of the positively buoyant member 112 and/or the attachment point of the negatively buoyant member 115. In one or more embodiments, one or more curvature control devices can be located at the attachment point of the riser 106 to the vessel 109 and/or the attachment point of the riser 106 and the subsea unit 103. In one or more embodiments, one or more curvature control devices can be located intermediate the attachment point of the riser 106 to the vessel 109 and the attachment point of the riser 106 to the subsea unit 103. In one or more embodiments, the curvature control device can include tapered stress joints, short lengths of pipe having increasing thickness welded or otherwise connected together to provide a stress joint, and short flex-joints. The curvature control device can be made from any suitable rigid material, for example metal or metal alloys. Illustrative metals can include, but are not limited to steel, stainless steel, and titanium.

In one or more embodiments, the hydrocarbon production system 100 can include a plurality of risers 106. The hydrocarbon production system 100 can include two or more, four or more, six or more, eight or more, or 10 or more risers 106. In one or more embodiments, the hydrocarbon production system 100 can include five or more risers 106, 12 or more risers 106, 15 or more risers 106, or 20 or more risers 106. In one or more embodiments, for a hydrocarbon production system 100 that includes two or more risers 106, the risers 106 can terminate at and connect to any one of a number types of subsea units 103, including, but not limited to, manifolds, well heads, blowout preventers ("BOP"), and well head assemblies, for example.

Figure 3:
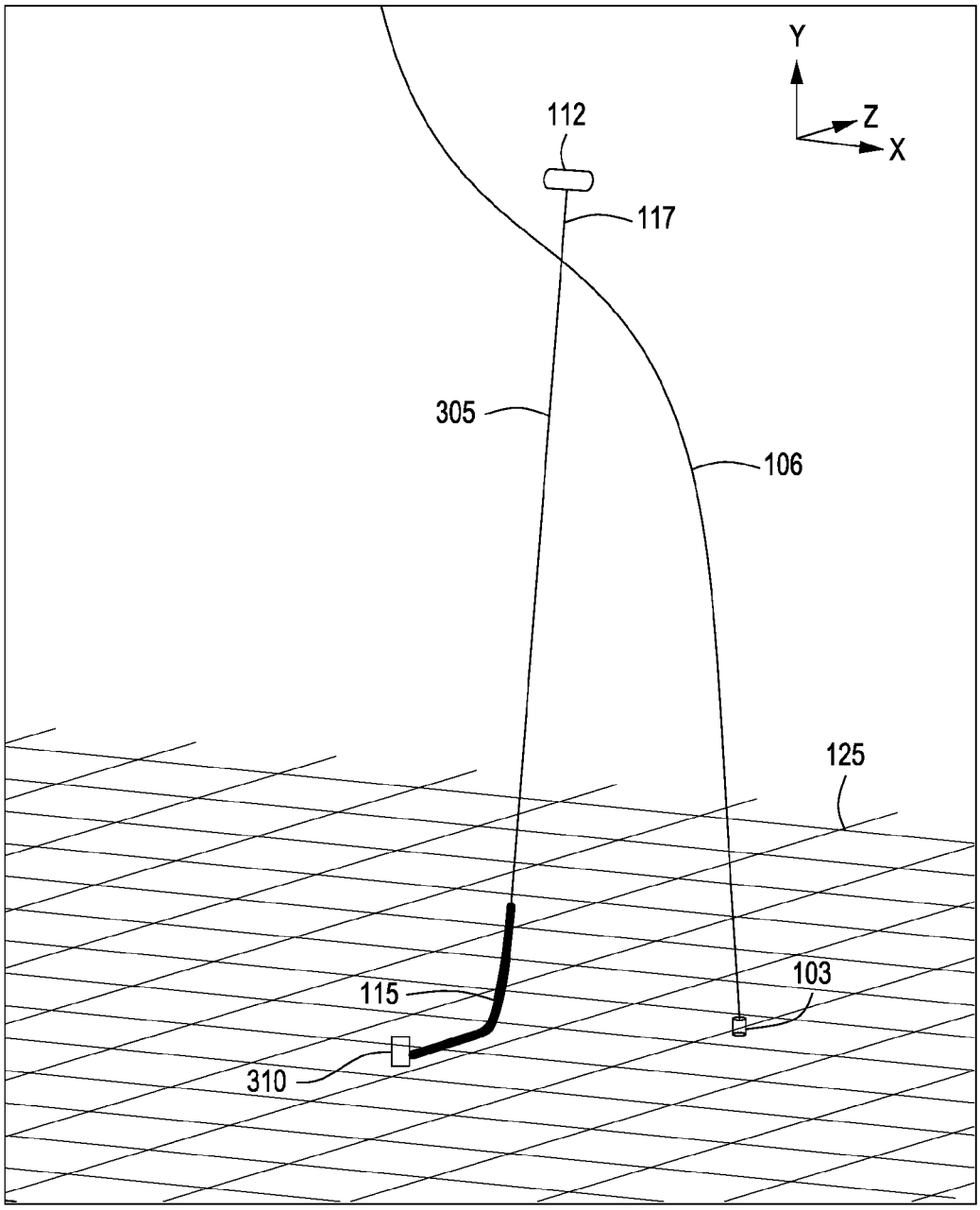
FIG. 3 depicts a close-up isometric view of an illustrative riser control system, according to one or more embodiments described.

FIG. 3 depicts a close-up isometric view of an illustrative riser control system, according to one or more embodiments. In one or more embodiments, the negatively buoyant member 115 can be connected to the riser 106 via one or more lines 305. The line 305 can be a light weight member relative to the negatively buoyant member 115. For example, the line 305 can be at least 0.01% less than the weight of the negatively buoyant member 115. The line 305 can be, but is not limited to, one or more metal cables, synthetic ropes, natural ropes, chains, and the like. The use of line 305 can reduce the constant portion of the restoring force exerted on the riser 106 by the negatively buoyant member 115, because the length of the negatively buoyant member 115 ultimately suspended from the riser 106 can be advantageously reduced.

The length of line 305 can be adjusted based upon the type of negatively buoyant member 115. For example, a negatively buoyant member 115 that includes a chain can require a certain amount of the chain be suspended from the riser 106 when the riser is in the operational null position with the remainder of the negatively buoyant member 115 resting on the seabed 125. One of the factors that can determine the amount or length of chain required to be suspended from the riser 106 can be the weight per length of chain. In other words, the heavier the chain per unit of length, the longer the line 305 can be in order to suspend the appropriate amount of the negatively buoyant member 115 from the riser 106, when the riser control system is in the operational null position.

In one or more embodiments, the negatively buoyant member 115 can be attached to one or more pilings or anchors 310. The one or more pilings or anchors 310 can be any device suitable for maintaining the end of the negatively buoyant member 115 in a fixed or substantially fixed location. The one or more pilings or anchors 310 can be a temporary or permanent anchor. Illustrative anchors can include, but are not limited to, fluke, grapnel, plough, claw, mushroom, screw, deadweight, or the like. In one or more embodiments, the one or more pilings or anchors 310 can be a cement or concrete pole or tower secured into the seabed 125.

The one or more pilings or anchors 310 can prevent the end of the negatively buoyant member 115 from being raised off the seabed 125. In one or more embodiments, maintaining the end of the negatively buoyant member 115 in a fixed or semi-fixed location can provide a reliable or semi-reliable negatively buoyant force via the negatively buoyant member 115 on the riser 106. The negatively buoyant member 115 can be attached to the one or more pilings or anchors 310 by welding, bolting, riveting, hooks, or the like. In one or more embodiments, the end of the negatively buoyant member 115 can be buried into the seabed 125. In one or more embodiments, the end of the negatively buoyant member 115 can be cemented or otherwise secured in the seabed 125.

Figure 4:
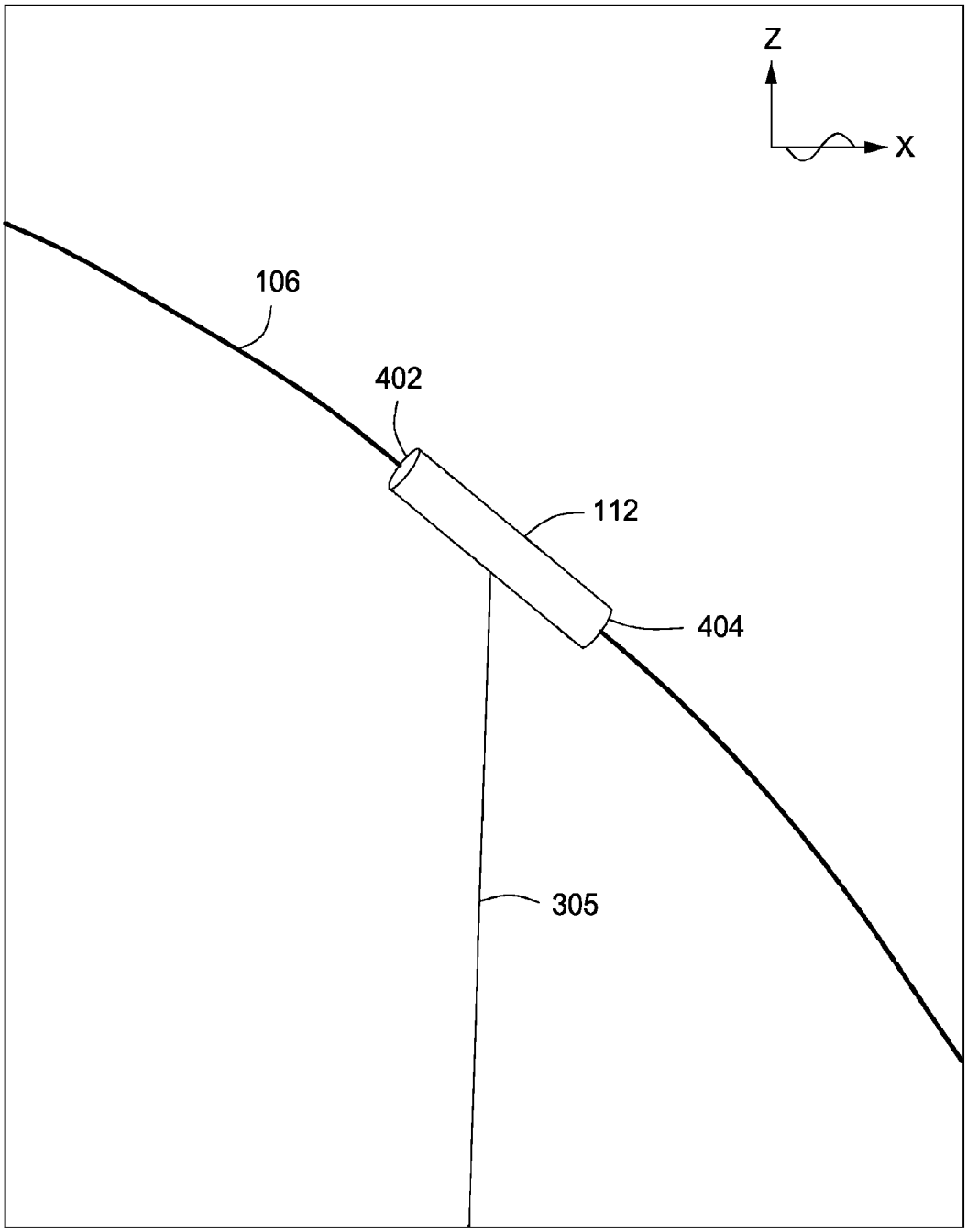
FIG. 4 depicts a close-up isometric view an illustrative positively buoyant member disposed about a riser, according to one or more embodiments described.

FIG. 4 depicts a close-up isometric view an illustrative positively buoyant member 112 disposed about a riser 106, according to one or more embodiments. The positively buoyant member 112 can be at least partially disposed about a length or section of the riser 106. The positively buoyant member 112 can be disposed about the riser 106, such that the positively buoyant member 112 surrounds at least a portion of one or more curvature control devices in the riser 106.

In one or more embodiments, the positively buoyant member 112 can be disposed about at least a portion of an outer circumference or diameter of the riser 106. The positively buoyant member 112 can be disposed about an outer diameter of the riser 106. The positively buoyant member 112 can have any thickness and any length.

The positively buoyant member 112 can have a thickness and/or length, which can be determined based at least in part on the buoyant properties of the particular buoyant material or materials chosen, to provide a desired positive buoyant force for the hydrocarbon production system 100 (see FIGS. 1 and 2).

The positively buoyant member 112 can have any cross-sectional shape. In one or more embodiments, the positively buoyant member 112 can be divided into two or more longitudinal units, for example the positively buoyant member 112 can be a cylinder having a bore therethrough, which can be split in half along the longitudinal axis to provide two longitudinal units. The positively buoyant member 112 can be a single module, such as a cylinder having a bore therethrough, which can be slipped over the riser 106 during installation. The positively buoyant member 112 can be a single module, such as a cylinder having a bore therethrough, which can be longitudinally cut from a first end to a second end to provide a positively buoyant member 112 having a slit or gap about its length. Such a positively buoyant member 112 can be opened and slipped over the riser 106 during installation. A positively buoyant member 112 that can be or include one or more pieces of buoyant material can be banded together about the riser 106, affixed about the riser 106 using adhesives, or otherwise prevented from falling off or moving along the riser 106.

As illustrated the positively buoyant member 112 can include a tubular shape having a curved outer surface. The curved outer surface can reduce drag and/or vortex induced vibrations ("VIV") on the riser 106 that can be caused by the current. The curved outer surface can be in the form or shape of a tear drop fairing, which can reduce drag and/or VIV on the riser 106. The positively buoyant member 112 can include one or more fins (not shown) attached to or otherwise disposed about the positively buoyant member 112, which can further reduce VIV. The one or more fins can be helically arranged or disposed in any pattern having any frequency or pattern of repetition about the positively buoyant member 112. In one or more embodiments, one or more strakes can be disposed about the positively buoyant member 112 and/or the riser 106, which can reduce drag and/or VIV. In one or more embodiments, the positively buoyant member 112 can be or include one or more positively buoyant strakes, fairings, shrouds, or other VIV reduction devices.

The positively buoyant member 112 can be one or more discrete or independent modules. For example, in at least one specific embodiment, the positively buoyant member 112 can include two cylindrical modules that can be disposed about the riser 106 proximate one another. In this particular embodiment, the negatively buoyant member can be attached or connected to the riser 106 between the two positively buoyant members 112.

In one or more embodiments, a positively buoyant member 112 disposed about at least a portion of the riser 106, i.e. in contact with at least a portion of the riser 106, can be secured using one or more adhesives, clamps, straps, bands, collars, and the like. For example, in at least one specific embodiment at least one collar (not shown) can be disposed about the riser 106, such that the collar prevents the positively buoyant member 112 from rising upward along the riser 106. In one or more embodiments, two or more collars can be disposed about the riser 106 such that at least one collar is disposed about the riser 106 at each end of the positively buoyant member 112.

In one or more embodiments, the attachment of the negatively buoyant member 115 via line 305 can be located at the central region of the positively buoyant member 112, as illustrated. In one or more embodiments, the attachment of the negatively buoyant member 115 via line 305 can be located toward a first end 402 of the positively buoyant member 112 or a second end 404 of the positively buoyant member 112. In one or more embodiments, the attachment of the negatively buoyant member 115 via line 105 can be located at two or more points about the length of the positively buoyant member 112. In one or more embodiments, the attachment of the negatively buoyant member 115 can be located on the riser 106, rather than overlapping the positively buoyant member 112. In one or more embodiments, the distance between the attachment point of the negatively buoyant member 115 via line 305 and the first end 402 and/or the second end 404 of the positively buoyant member 112 can range from a low of about 0.1 m, about 0.5 m, or about 1 m to a high of about 3 m, about 4 m, or about 5 m. In one or more embodiments, and as shown in FIGS. 1 and 2, the negatively buoyant member 115 can be directly attached to the riser 106.

Figure 5:
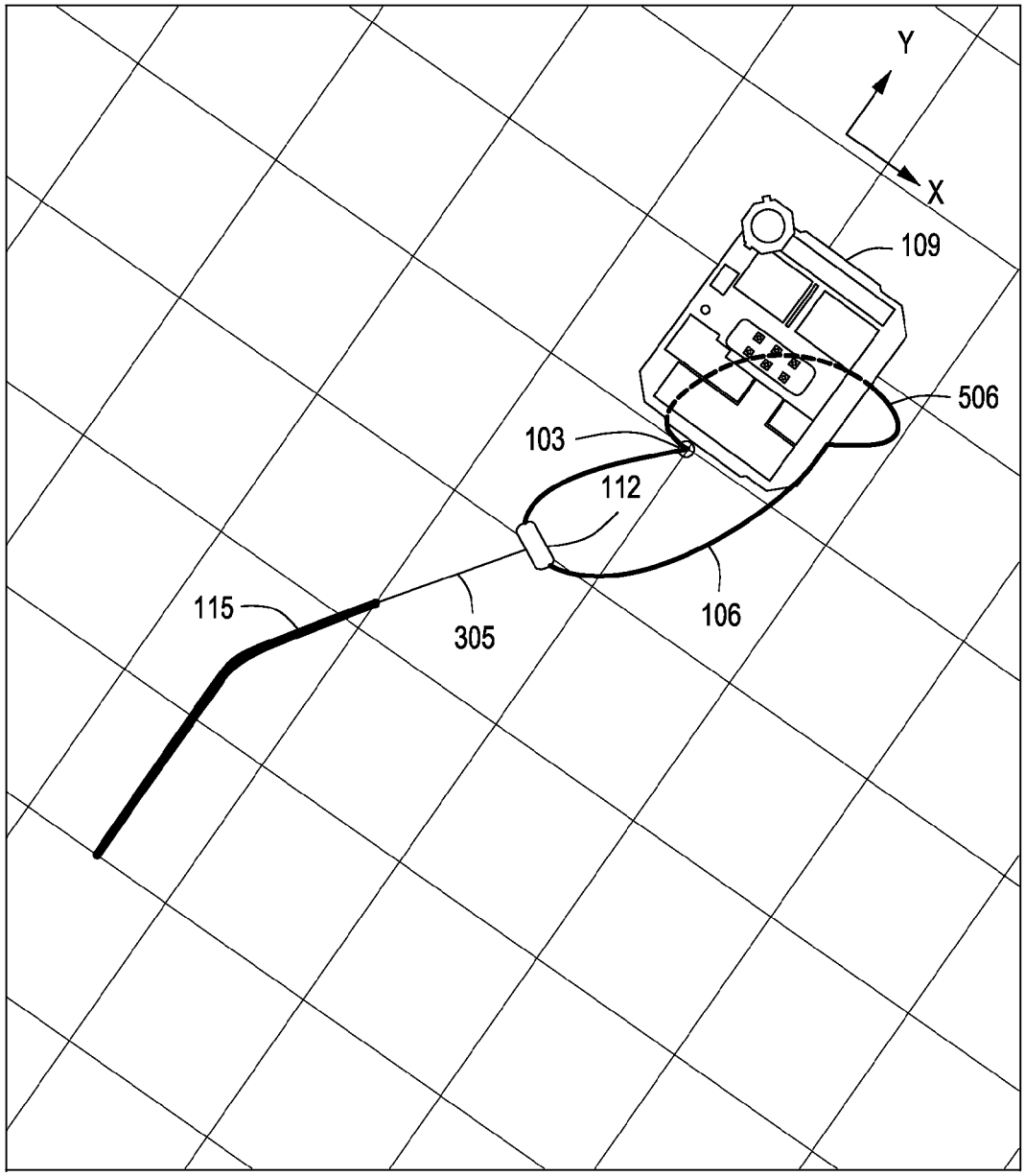
FIG. 5 depicts a plan view of an illustrative offshore hydrocarbon production system having a riser connected to a vessel displaced such that the top of the riser has passed beyond its base, according to one or more embodiments described.
Figure 6:
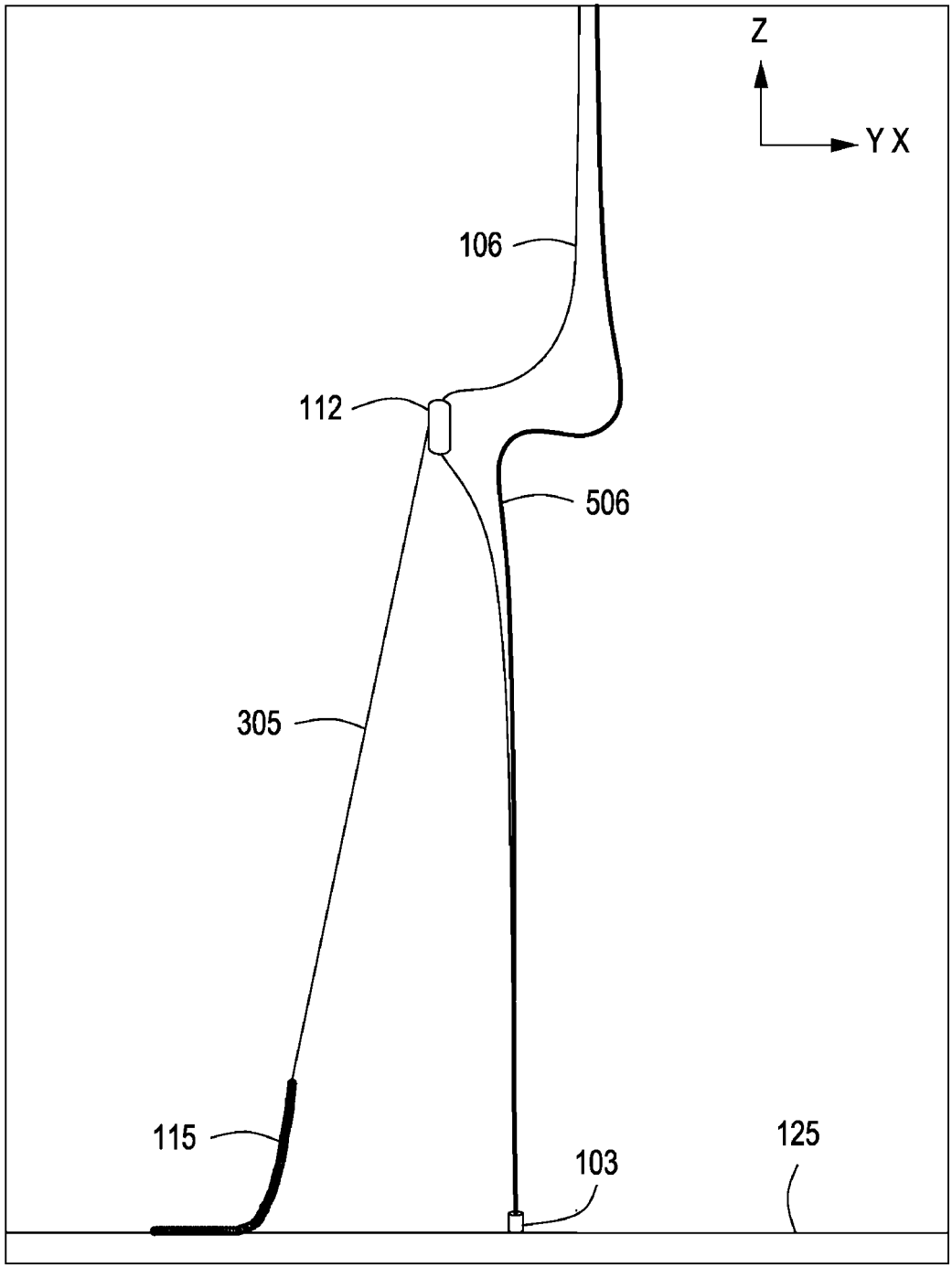
FIG. 6 depicts an elevation view of the illustrative offshore hydrocarbon production system shown in FIG. 5.

FIG. 5 depicts a plan view of an illustrative offshore hydrocarbon production system 100 having a riser 106 connected to a vessel 109 displaced such that the top of the riser 106 has passed beyond its base, according to one or more embodiments. FIG. 6 depicts an elevation view of the illustrative offshore hydrocarbon production system shown in FIG. 5, according to one or more embodiments. Referring to FIGS. 5 and 6, the vessel 109 has been displaced in the positive X direction and the positive Y direction, such that the top of the riser 106 has passed beyond the bottom of the riser 106. The riser 106 that includes the positively buoyant member 112 and the negatively buoyant member 115 attached thereto, has been restrained. However, the riser 506 that does not include the positively buoyant member 112 and the negatively buoyant member 115 has deflected out of plane. Referring to FIG. 6, it can be seen that a hydrocarbon production system 100 that includes a plurality of risers 106 could clash with one another as they deflect. The positively buoyant member 112 and the negatively buoyant member 115 can reduce or eliminate the potential for clashing between two or more risers 106.

Figure 7:
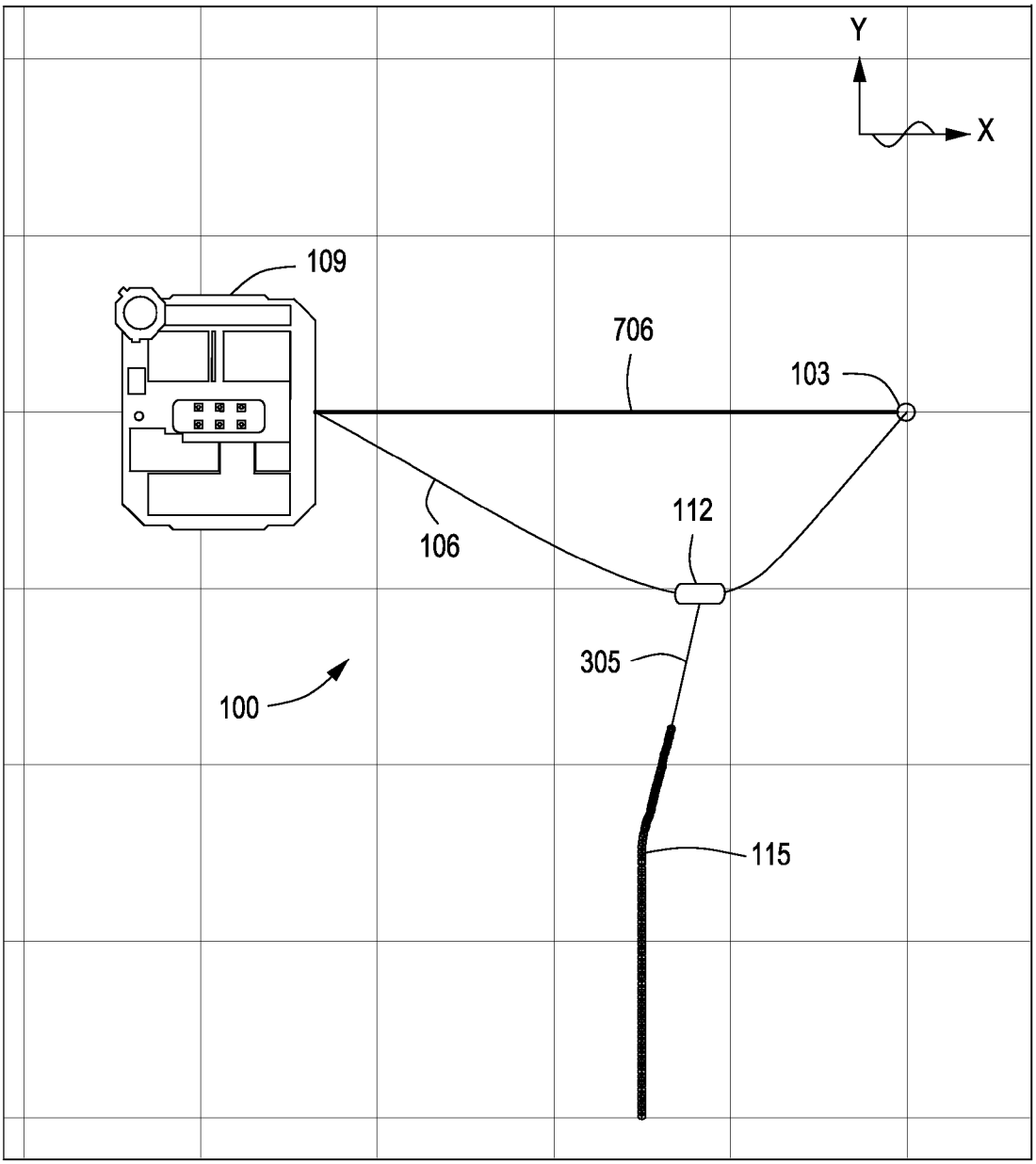
FIG. 7 depicts a plan view of an illustrative offshore hydrocarbon production system having a downwards vertical displacement of a controlled riser and an uncontrolled riser due to increased fluid density, according to one or more embodiments described.
Figure 8:
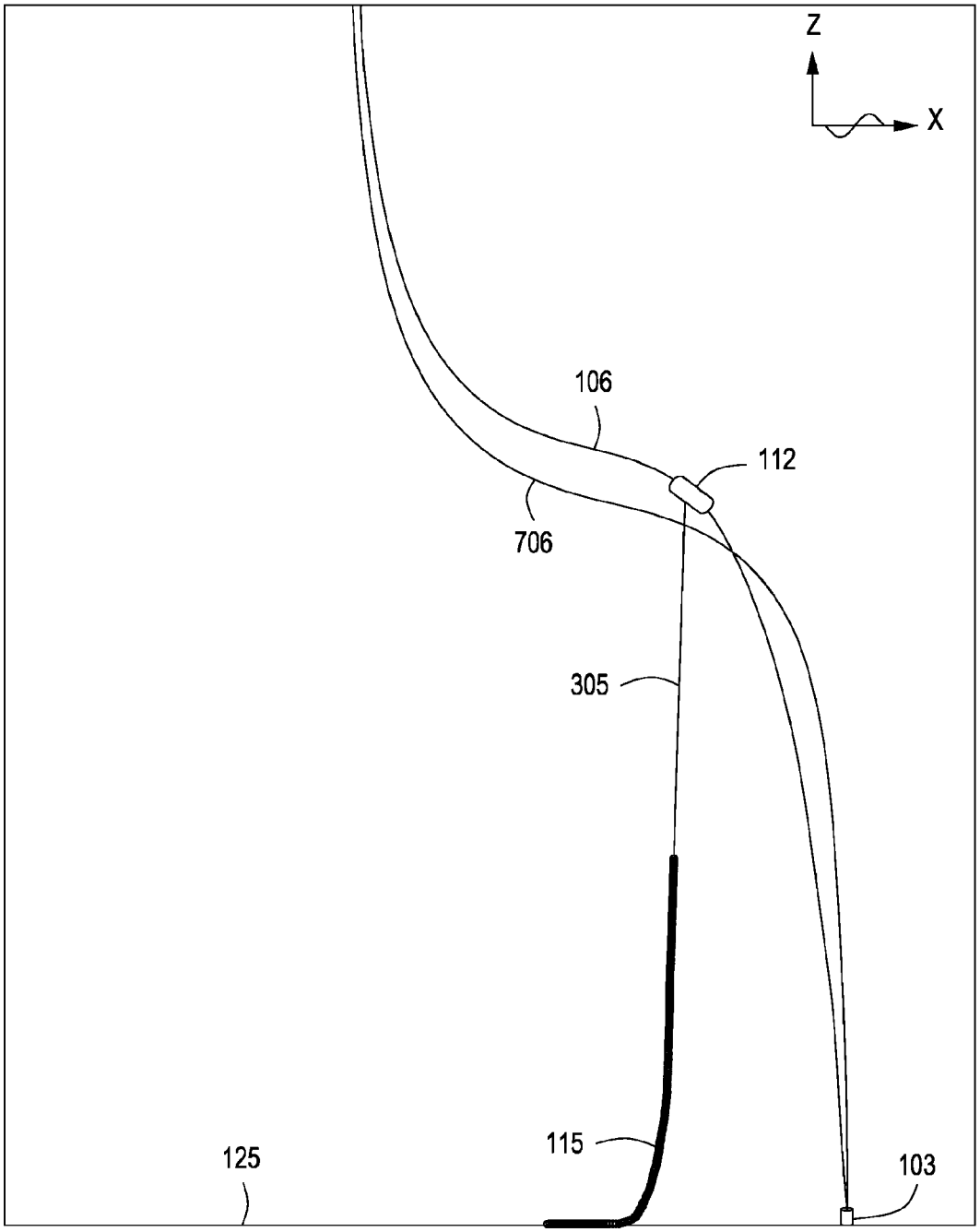
FIG. 8 depicts an elevation view of the illustrative offshore hydrocarbon production system shown in FIG. 7.

FIG. 7 depicts a plan view of an illustrative offshore hydrocarbon production system 100 having a downwards vertical displacement of a controlled riser 106 and an uncontrolled riser 706 due to increased fluid density, according to one or more embodiments. FIG. 8 depicts an elevation view of the illustrative offshore hydrocarbon production system shown in FIG. 7, according to one or more embodiments. As illustrated in FIGS. 7 and 8, the risers 106 and 706 have a fluid flowing therethrough. The fluid can be any fluid having a density greater than the water surrounding the risers 106, 107. For example, the fluid can be heavy hydrocarbons, drilling-mud, and the like. As the density of the fluid flowing through the risers 106, 706 increases, the risers 106, 706 can tend to sink or move toward the seabed 125. However, the riser 106 that includes the positively buoyant member 112 and the negatively buoyant member 115 is vertically displaced less than the riser 706 that does not include a positively buoyant member 112 and a negatively buoyant member 115 attached thereto. The positive force exerted on the riser 106 due to the positively buoyant member 112 and the reduced negative force exerted on the riser 106 due to an additional portion of the negatively buoyant member 115 depositing on the sea bed 125 (see FIG. 1, for example) reduces the vertical drop or vertical displacement of the riser 106 when a fluid or any other material, tool, or the like having a density greater than the water surrounding the riser 106 passes through the riser 106. As such, the hydrocarbon production system 100 can act as a "vertical spring" that can reduce or prevent the vertical displacement of the riser 106. The adverse consequences of this vertical displacement away from the operational null position can be an increased amount of curvature in the riser 106 and possibly the formation of a sag or bend in the riser 106 where liquids in a multi-phase fluid could collect and/or could cause blockage of a tool from passing therethrough.

As discussed and described above with reference to FIGS. 1 and 2, the positively buoyant member 112 can be adjustable. In other words, the buoyancy of the positively buoyant member 112 can be increased or decreased in response to one or more forces acting on the hydrocarbon production system 100. Adjusting the buoyancy of the positively buoyant member 112 can adjust or change the "spring" control provided by the positively buoyant member 112 and the negatively buoyant member 115, thereby changing the operational null position of the hydrocarbon production system 100. Therefore, the introduction of a heavy or dense fluid to the riser 106 can also include or otherwise be accompanied by an increase in the buoyancy of the positively buoyant member 112. Likewise, the introduction of a light fluid, such as a hydrocarbon gas, can include or otherwise be accompanied by a decrease in the buoyancy of the positively buoyant member 112. The buoyancy can be adjusted via a ROV, an automated system that can be disposed on the vessel 109, about the riser 106 or the positively buoyant member 112, or on the seabed 125 that can introduce or remove one or more fluids, for example air and/or water, disposed within a hollow portion of the positively buoyant member 112 via one or more conduits, such as a flexible tubular hose. If a hydrocarbon production system 100 includes two or more positively buoyant members 112, either disposed on a single riser 106 or a plurality of risers 106, the buoyancy of two or more of the positively buoyant members 112 can be modified by transferring fluid therebetween.

The particular location of the attachment points on the riser 106 for the positively buoyant member 112 and the negatively buoyant member 115 can affect the stress directed or exerted by the positively buoyant member 112 and the negatively buoyant member 115 on the riser 106. In one or more embodiments, the particular location of the attachment points for the positively buoyant member 112 and the negatively buoyant member 115 can be determined or based, at least in part, on a desired maximum stress that can be directed on the riser 106 during operation without causing damage to the riser 106.

Figure 9:
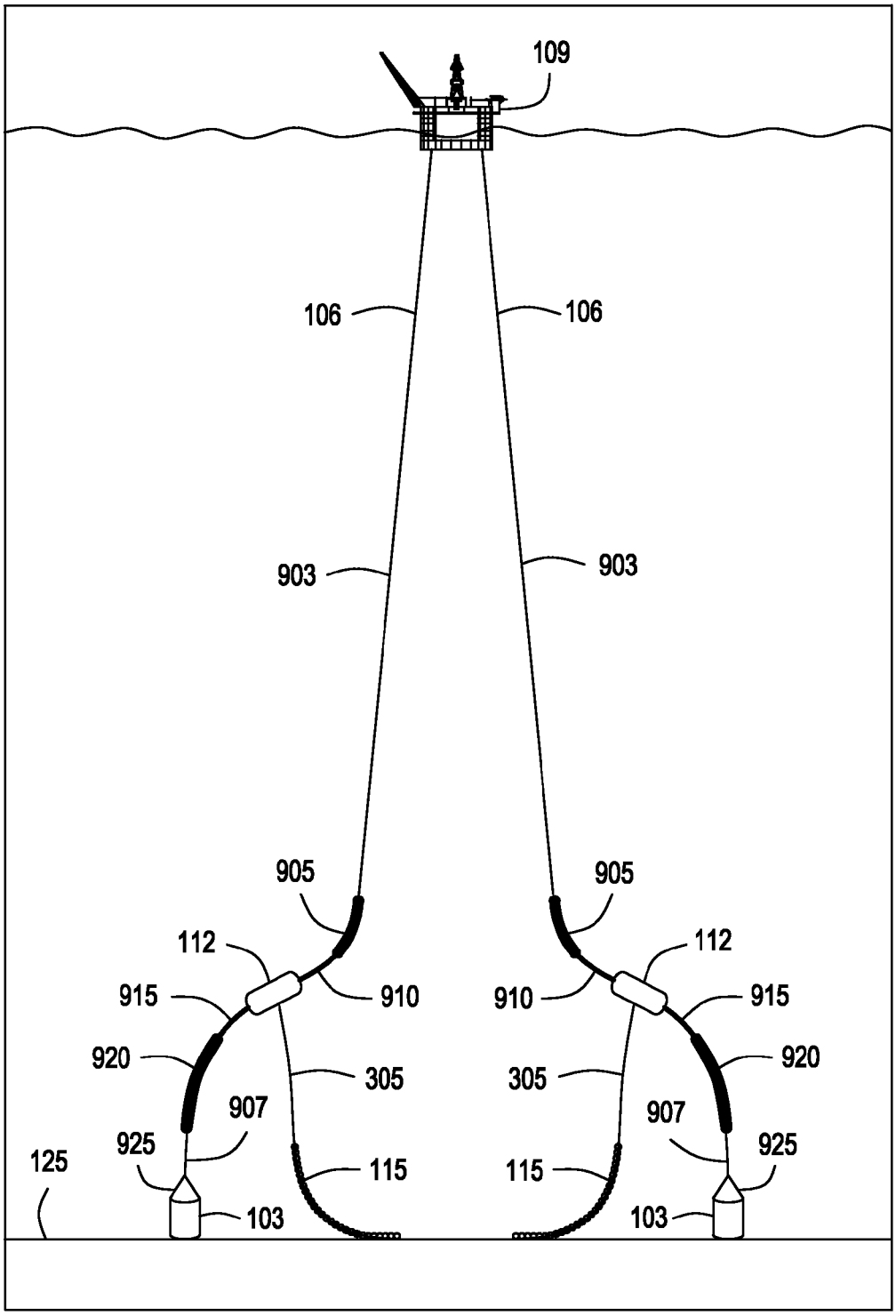
FIG. 9 depicts an isometric view of an illustrative offshore hydrocarbon production system having a plurality of variable tension risers, according to one or more embodiments described.

FIG. 9 depicts an elevation view of an illustrative offshore hydrocarbon production system 100 having a plurality of variable tension risers 106, according to one or more embodiments. The hydrocarbon production system 100 can include a plurality of variable tension risers 106 (two are shown). In one or more embodiments, the variable tension risers 106 can include a series of segments or regions, e.g. single or multiple pipe joints, having varying buoyancy. As illustrated, for example, the variable tension risers 106 can include an upper negatively buoyant region (riser portion 903), a weighted region 905, a first variably buoyant region 910, a positively buoyant member 112, a second variably buoyant region 915, a positively buoyant region 920, and a lower negatively buoyant region (riser portion 907). In one or more embodiments, a negatively buoyant member 115 can be attached to the riser via line 305 proximate the positively buoyant member 112, as discussed and described above with reference to FIGS. 1-8. In one or more embodiments, the hydrocarbon production system 100 can include one or more curvature control devices 925. The curvature control device 925 can be curved, precurved, keel, and/or flexible to provide a durable connection between the riser 106 and the subsea unit 103. In one or more embodiments, a curvature control device 925 can also be disposed at the connection point between the riser 106 and the vessel 109. In one or more embodiments, one or more curvature control devices 925 can be disposed along the riser at one or more positions between the connection points between the riser 106 and the vessel 109 and the riser 106 and the subsea unit 103. For example, a curvature control device 925 can be disposed on one or both sides of the positively buoyant member 112 disposed about the risers 106.

In one or more embodiments, the upper negatively buoyant region 903 and/or the lower negatively buoyant region 907 can be substantially vertical. For example, the upper negatively buoyant region 903 and/or the lower negatively buoyant region 907 can be less than about 30°, less than about 25°, less than about 20°, or less than about 15° of vertical. In one or more embodiments, the weighted region 905, the first variably buoyant region 910, the positively buoyant region 112, the second variably buoyant region 915, and the positively buoyant region 920 disposed between the upper negatively buoyant region 903 and the lower negatively buoyant region 907 can be curved. Although not shown, the positively buoyant region 920 can extend about the riser 106 to the subsea unit 103 thereby eliminating the lower negatively buoyant region 907.

In one or more embodiments, the first variably buoyant region 910 and/or the second variably buoyant section 915 can include a plurality of variably buoyant sections. For example, the first variably buoyant region 910 can include two or more, four or more, six or more, eight or more, or ten or more sections that have varying or different buoyancy. In one or more embodiments, the buoyancy of the first variably buoyant region 910 can increase from the upper end to the lower end of the first variably buoyant region 910. In one or more embodiments, the buoyancy of the first variably buoyant region 910 can decrease from the upper end to the lower end of the first variably buoyant region 910.

In one or more embodiments, the buoyancy of the second variably buoyant region 915 can increase from the upper end to the lower end of the second variably buoyant region 915. In one or more embodiments, the buoyancy of the second variably buoyant region 915 can decrease from the upper end to the lower end of the second variably buoyant region 915.

As illustrated in FIG. 9, the hydrocarbon production system 100 can include a negatively buoyant region 903, a weighted region 905, a first variably buoyant region 910, a positively buoyant member 112, a second variably buoyant region 915, a positively buoyant region 920, and a second negatively buoyant region 907. The positively buoyant region 920 can provide a tension or upward force on the second negatively buoyant region 907. In one or more embodiments, the negatively buoyant region 903 and the weighted region 905 can hang below the vessel 109. In one or more embodiments, the weighted region 905 can be disposed between or intermediate the negatively buoyant region 903 and the first variably buoyant region 910. In one or more embodiments, the positively buoyant member 112 can be disposed between the first variably buoyant region 910 and the second variably buoyant region 915. In one or more embodiments, the positively buoyant region 920 can be positioned to provide a positive tension in the second negatively buoyant region 907. In one or more embodiments, the second negatively buoyant region 907 can be connected to the subsea unit 103. In one or more embodiments, a curvature control device 925 can be disposed between the distal end of the second negatively buoyant region 907 (riser 106) and the subsea unit 103. In one or more embodiments, the negatively buoyant member 115 can be connected directly to the riser 106 or via line 305, as shown, at a location proximate the positively buoyant member 112. In one or more embodiments, the negatively buoyant member 115 can be connected directly to the riser 106 or via line 305 at a location coinciding with the attachment of the positively buoyant member 112. In one or more embodiments, at least a portion of the negatively buoyant member 115 can rest on the seabed 125. In one or more embodiments, the end of the negatively buoyant member 115 can be attached or otherwise connected to one or more anchors or pilings 310 (see FIG. 3) disposed on, in, or about the seabed 125.

Figure 10:
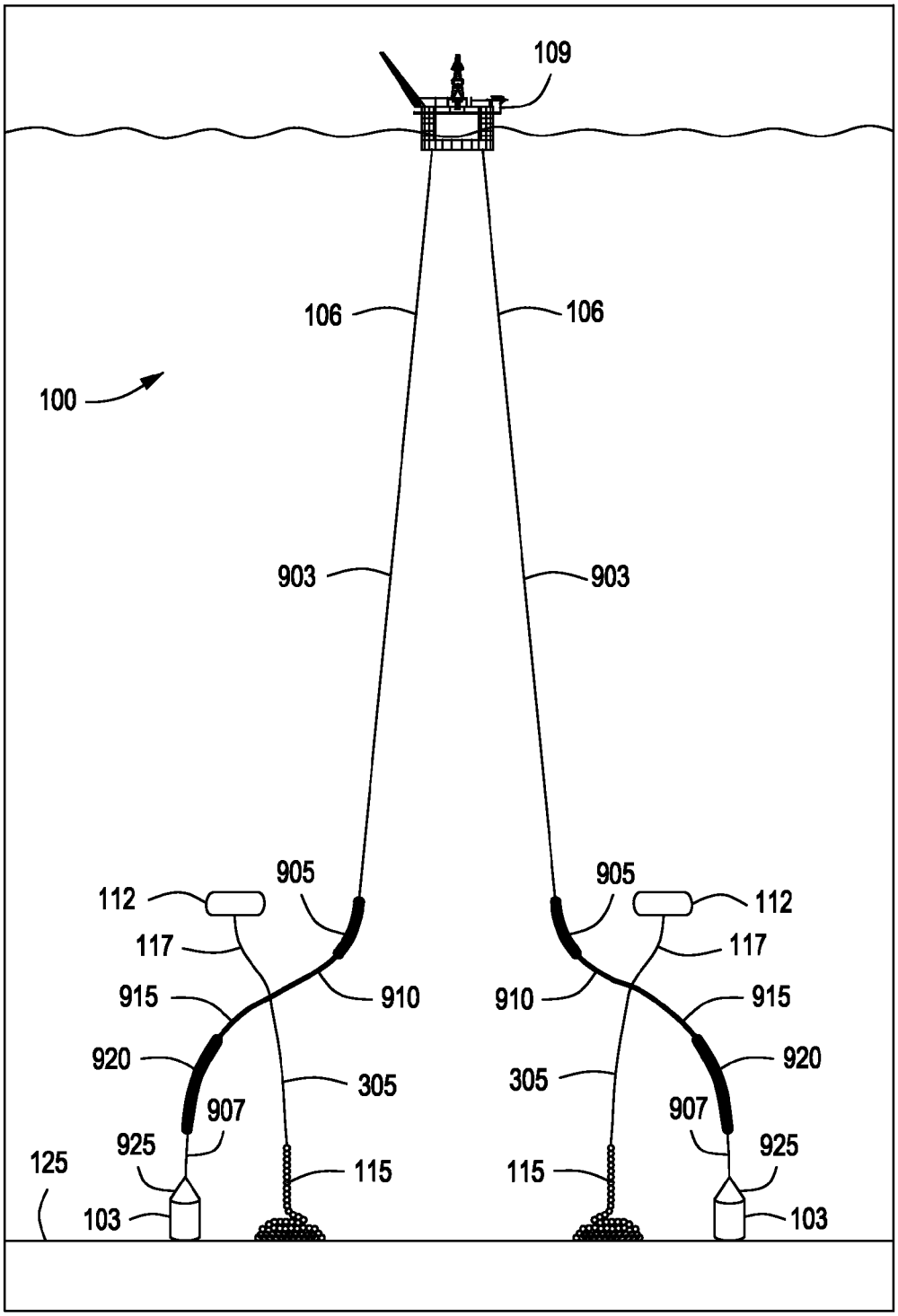
FIG. 10 depicts another isometric view of an illustrative offshore hydrocarbon production system having a plurality of variable tension risers, according to one or more embodiments described.

FIG. 10 depicts another elevation view of an illustrative offshore hydrocarbon production system 100 having a plurality of variable tension risers 106, according to one or more embodiments. The hydrocarbon production system 100 can be similar as discussed and described above with reference to FIG. 9. In one or more embodiments, the positively buoyant member 112 can be attached to the riser 106 via attachment line 117, as discussed and described above with reference to FIGS. 1-3. In one or more embodiments, the negatively buoyant member 115 can puddle or otherwise pile up directly beneath the riser 106. As the position of the riser 106 changes position the negatively buoyant member 115 can be lifted off the seabed 125 or can be deposited onto the seabed 125 in a pile.

As illustrated in FIG. 10, the hydrocarbon production system 100 can include a negatively buoyant region 903, a weighted region 905, a first variably buoyant region 910, a positively buoyant member 112 attached to the riser 106 via a line 117, a second variably buoyant region 915, a positively buoyant region 920, and a second negatively buoyant region 907. The positively buoyant region 920 can provide a tension or upward force on the second negatively buoyant region 907. In one or more embodiments, the negatively buoyant region 903 and the weighted region 905 can hang below the vessel 109. In one or more embodiments, the weighted region 905 can be disposed between or intermediate the negatively buoyant region 903 and the first variably buoyant region 910. In one or more embodiments, the positively buoyant member 112 can be attached or otherwise connected to the riser 106 via line 117 between the first variably buoyant region 910 and the second variably buoyant region 915. In one or more embodiments, the positively buoyant region 920 can be positioned to provide a positive tension in the second negatively buoyant region 907. In one or more embodiments, the second negatively buoyant region 907 can be connected to the subsea unit 103. In one or more embodiments, a curvature control device 925 can be disposed between the distal end of the second negatively buoyant region 907 (riser 106) and the subsea unit 103. In one or more embodiments, the negatively buoyant member 115 can be connected directly to the riser 106 or via line 305, as shown, at a location proximate the positively buoyant member 112. In one or more embodiments, the negatively buoyant member 115 can be connected directly to the riser 106 or via line 305 at a location coinciding with the attachment position of the positively buoyant member 112 via line 117. In one or more embodiments, at least a portion of the negatively buoyant member 115 can rest below the riser 106 on the seabed 125 in a pile. In one or more embodiments, the end of the negatively buoyant member 115 can be attached or otherwise connected to one or more anchors or pilings 310 (see FIG. 3) disposed on, in, or about the seabed 125.

In one or more embodiments, the upper negatively buoyant region 903 and/or the lower negatively buoyant region 907 can be substantially vertical. For example, the upper negatively buoyant region 903 and/or the lower negatively buoyant region 907 can be less than about 30°, less than about 25°, less than about 20°, or less than about 15° of vertical. In one or more embodiments, the weighted region 905, the first variably buoyant region 910, the second variably buoyant region 915, and the positively buoyant region 920 disposed between the upper negatively buoyant region 903 and the lower negatively buoyant region 907 can be curved. Although not shown, the positively buoyant region 920 can extend about the riser 106 to the subsea unit 103 thereby eliminating the lower negatively buoyant region 907.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for controlling movement of an elongated member providing communication between a vessel and a subsea unit, comprising:

connecting a first end of the elongated member to the vessel;

connecting a second end of the elongated member to the subsea unit;

connecting a positively buoyant member to the elongated member; and connecting a negatively buoyant member to the elongated member at an attachment point having a fixed longitudinal position between the first end and the second end of the elongated member, wherein at least a portion of the negatively buoyant member rests on a seabed, wherein a portion of the negatively buoyant member forms a pile beneath the elongated member, wherein the positively buoyant member is connected to a first location of the elongated member and the negatively buoyant member is connected to a second location of the elongated member, and wherein a distance between the first location and the second location is less than about 50 meters.

2. The method of claim 1, further comprising increasing a force provided by the negatively buoyant member as the elongated member moves in a direction away from the negatively buoyant member.

3. The method of claim 1, further comprising decreasing a force provided by the negatively buoyant member as the elongated member moves in a direction toward the negatively buoyant member.

4. The method of claim 1, further comprising, modifying a force provided by the positively buoyant member by at least one of adding a buoyant material to the positively buoyant member, removing a portion of the positively buoyant member, introducing a fluid to the positively buoyant member, and removing a fluid from the positively buoyant member.

5. The method of claim 1, further comprising modifying a force provided by the negatively buoyant member by at least one of adding negatively buoyant material to the negatively buoyant member and removing a portion of the negatively buoyant member.

6. The method of claim 1, wherein the distance between the first location and the second location is less than about 3 meters.

7. The method of claim 1, wherein connecting the negatively buoyant member to the elongated member comprises connecting the negatively buoyant member to one or more lines and directly connecting the one or more lines to the elongated member.

8. The method of claim 1, wherein at least a portion of the negatively buoyant member is in direct contact with the seabed.

9. The method of claim 1, wherein the negatively buoyant member is directly attached to one or more pilings or anchors secured to the seabed.

10. The method of claim 9, wherein the negatively buoyant member is bolted or welded to the one or more pilings or anchors.

11. The method of claim 1, wherein the distance between the first location and the second location is from about 1 meter to about 3 meters.

12. The method of claim 1, wherein the elongated member does not rest on the seabed.

13. The method of claim 1, wherein at least a portion of the negatively buoyant member is vertically suspended from the elongated member.

* * * * *